US008207931B2

(12) United States Patent
Zhang et al.

(10) Patent No.: US 8,207,931 B2
(45) Date of Patent: Jun. 26, 2012

(54) METHOD OF DISPLAYING A LOW DYNAMIC RANGE IMAGE IN A HIGH DYNAMIC RANGE

(75) Inventors: Wei Zhang, Hong Kong (CN); Huajun Peng, Hong Kong (CN); Chen-Jung Tsai, Hong Kong (CN)

(73) Assignee: Hong Kong Applied Science and Technology Research Institute Company Limited, Shatin, New Territories (HK)

( * ) Notice: Subject to any disclaimer, the term of this patent is extended or adjusted under 35 U.S.C. 154(b) by 698 days.

(21) Appl. No.: 11/809,095

(22) Filed: May 31, 2007

(65) Prior Publication Data

US 2008/0297460 A1 Dec. 4, 2008

(51) Int. Cl.
*G09G 3/36* (2006.01)
*G09G 5/02* (2006.01)

(52) U.S. Cl. ..... 345/102; 345/605

(58) Field of Classification Search ..... None
See application file for complete search history.

(56) References Cited

U.S. PATENT DOCUMENTS 4,825,297 A * 4/1989 Fuchsberger et al. ..... 358/447
5,210,610 A * 5/1993 Kanashiki et al. ..... 348/672
5,764,216 A * 6/1998 Tanaka et al. ..... 345/87
6,101,273 A * 8/2000 Matama ..... 382/169
6,118,820 A * 9/2000 Reitmeier et al. ..... 375/240.16
6,393,148 B1 * 5/2002 Bhaskar ..... 382/169
6,453,074 B1 * 9/2002 Zheng ..... 382/260
6,795,053 B1 * 9/2004 Funamoto et al. ..... 345/102
6,914,614 B2 * 7/2005 Kobayashi ..... 345/600
7,006,692 B2 2/2006 Matsushima
7,064,740 B2 6/2006 Daly
7,102,697 B2 * 9/2006 Lei et al. ..... 348/678
7,502,010 B2 * 3/2009 Kirk ..... 345/102
7,639,893 B2 * 12/2009 Duan et al. ..... 382/274
2003/0012437 A1 * 1/2003 Zaklika et al. ..... 382/169
2004/0239796 A1 * 12/2004 Imai ..... 348/362
2004/0257329 A1 * 12/2004 Park et al. ..... 345/102
2005/0025364 A1 * 2/2005 Kim et al. ..... 382/190
2005/0088373 A1 * 4/2005 Lee ..... 345/60
2005/0184952 A1 * 8/2005 Konno et al. ..... 345/102
2005/0200631 A1 9/2005 Pan et al.
2005/0248524 A1 * 11/2005 Feng et al. ..... 345/102
2005/0248583 A1 * 11/2005 Gotoda ..... 345/596
2006/0022906 A1 * 2/2006 Kamiyamaguchi et al. .... 345/63

(Continued)

OTHER PUBLICATIONS

U.S. Appl. No. 11/707,517, filed Feb. 16, 2007; entitled Backlight Device and Liquid Crystal Display Incorporating the Backlight Device; Peng et al; 25 pp.

*Primary Examiner* — Bipin Shalwala
*Assistant Examiner* — Daniel Bedell
(74) *Attorney, Agent, or Firm* — Wells St. John, PS

(57) ABSTRACT

A method of increasing the dynamic range of an image comprising a plurality of pixels each having a luminance value within a first luminance dynamic range. The method includes determining a background luminance value for each pixel of the image and determining a minimum and a maximum of the background luminance values. A conversion factor is then determined for each pixel of the image based on the minimum and maximum of the background luminance values. The image id converted from the first luminance dynamic range to a second luminance dynamic range by multiplying the luminance value of each pixel of the image by its conversion factor.

20 Claims, 5 Drawing Sheets

U.S. PATENT DOCUMENTS

2006/0044254 A1* 3/2006 Kirk ..... 345/102
2006/0104508 A1 5/2006 Daly et al.
2006/0104533 A1 5/2006 Daly et al.
2006/0109389 A1 5/2006 Ichikawa et al.
2006/0125745 A1 6/2006 Evanicky
2006/0214904 A1* 9/2006 Kimura et al. ..... 345/102
2006/0227125 A1* 10/2006 Wong et al. ..... 345/211
2006/0256240 A1* 11/2006 Oka et al. ..... 348/630
2006/0262077 A1 11/2006 Terasaka
2007/0001997 A1* 1/2007 Kim et al. ..... 345/102
2007/0002000 A1* 1/2007 Kwon ..... 345/102
2007/0024573 A1* 2/2007 Kamimura ..... 345/102
2007/0097321 A1* 5/2007 Whitehead et al. ..... 353/30
2007/0159451 A1* 7/2007 Daly ..... 345/102
2007/0223041 A1* 9/2007 Hsieh et al. ..... 358/3.01
2007/0263127 A1* 11/2007 Fainstain ..... 348/674
2007/0269104 A1* 11/2007 Whitehead et al. ..... 382/162
2007/0296689 A1* 12/2007 Kimura et al. ..... 345/102
2008/0107360 A1* 5/2008 Yamashita et al. ..... 382/313
2008/0123952 A1* 5/2008 Parkkinen et al. ..... 382/168
2008/0224977 A1* 9/2008 Park et al. ..... 345/89
2009/0059026 A1* 3/2009 Katagiri et al. ..... 348/222.1
2009/0141212 A1* 6/2009 Harbers et al. ..... 349/67
2009/0262067 A1* 10/2009 Feng et al. ..... 345/102
2010/0156965 A1* 6/2010 Kim et al. ..... 345/691

* cited by examiner

METHOD OF DISPLAYING A LOW DYNAMIC RANGE IMAGE IN A HIGH DYNAMIC RANGE

FIELD OF THE INVENTION

The present invention relates to a method of displaying an image, and in particular to displaying a low dynamic range image in a high dynamic range. The invention also relates to a method of increasing the dynamic range of an image.

BACKGROUND

The dynamic range of illumination in the real world which can reach up to 14 orders of magnitude from star light to sun light. The human eye can see a wide dynamic range of up to 5 orders of magnitude. However, most display devices can only display images with a dynamic range of around 2 orders of magnitude. Liquid crystal display panels for example can typically only display images having an 8-bit (256 step) luminance dynamic range. Therefore, a luminance mapping transfer is used to map from the dynamic range of the real world to the lower dynamic range of the display. This results in a lose of contrast and detail of the image. Generally this mapping is performed in the image capture stage since some digital cameras is able to capture images with 12 to 16 bits luminance dynamic range. Conversion from a greater to a lower luminance dynamic range for the display is referred to as Tone Mapping.

Recent developments in display technology have resulted in displays that can show images with a high luminance dynamic range. However, as many images are converted to a lower 8-bit luminance dynamic range n capture, and many conventional video has an 8-bit luminance dynamic range, there is a need for a reverse process of increasing the luminance dynamic range of a digital image for use with these high dynamic range displays. The most straight forward way to enlarge the dynamic range is simply multiple a constant to each pixel value. However, such linear stretch does not consider the image characteristic and human visual system property. As a result, it can not improve the image quality. Moreover, the linear scaling up approach may cause artifacts, such as introducing countering effect into gradually changing regions.

Accordingly, it is an object of the present invention to provide a method of displaying a low luminance dynamic range image in a higher luminance dynamic range.

SUMMARY OF THE INVENTION

There is disclosed herein a method of increasing the dynamic range of an image comprising a plurality of pixels each having a luminance value within a first luminance dynamic range, the method comprising:

- determining a background luminance value for each pixel of the image,
- determining a minimum and a maximum of the background luminance values,
- determining a conversion factor for each pixel of the image, wherein the conversion factor for each pixel is based on the minimum and maximum of the background luminance values,
- converting the image from the first luminance dynamic range to a second luminance dynamic range by multiplying the luminance value of each pixel of the image by its conversion factor.

Preferably, determining the background luminance value for each pixel of the image comprises, for each pixel in the image, finding an average of the luminance-value of said pixel and the luminance values of nearby pixels.

Preferably, determining the background luminance value for each pixel of the image comprises filtering the image with a low pass filter and determining a luminance value for each pixel of the filtered image.

Preferably, the low pass filter is a directional low pass filter.

Preferably, the image has a greater number of pixels than the filtered image.

Preferably, determining a conversion factor for each pixel of the image comprises providing a plurality of conversion factors for converting between the first luminance dynamic range and the second luminance dynamic range, wherein the plurality of conversion factors is based on the first and second luminance dynamic ranges, and selecting from amongst the plurality of conversion factors the conversion factor for each pixel of the image.

Preferably, the image comprises a red sub-image and green sub-image and a blue sub-image and the steps of claim 1 are performed on each of the sub-images.

Preferably, the method further comprises transforming the image from a RGB color format to a YUV color format before determining a background luminance value for each pixel of the image.

Preferably, the YUV color format comprises a Y component image having pixel luminance information and determining a background luminance value for each pixel of the image is performed only on a Y component image.

Preferably, the method further comprises transforming the converted image from the YUV color format to the RGB color format.

There is also disclosed herein a method of increasing the dynamic range of an image comprising receiving an image comprising a plurality of pixels each having a luminance value within a first luminance dynamic range, transforming the image into red, green and blue sub-images, performing the method of claim 1 on each of the sub-images and combining the converted red, green and blue sub-images into a high dynamic range image.

There is also disclosed herein a display apparatus for displaying an image, comprising:

- an LCD panel having a plurality of light transmissive display elements,
- an LCD controller for controlling light transmittance of the light transmissive display elements in response to a first image signal having a first luminance dynamic range,
- an LCD panel backlight having a plurality of light emitting devices for backlighting the light transmissive display elements,
- a backlight controller for individually controlling illumination of the light emitting devices in accordance with a second image signal having a second luminance dynamic range,
- an image processor programmed to perform the method of claim 1 for converting a received image signal between the first luminance dynamic range and the second luminance dynamic range.

There is also disclosed herein a method of displaying an image comprising a plurality of pixels each having a luminance value within a first luminance dynamic range, the method comprising:

- determining a background luminance value for each pixel of the image,
- determining a minimum and a maximum of the background luminance values, determining a conversion factor for each pixel of the image, wherein the conversion factor for each pixel is based on the minimum and maximum of the background luminance values, converting the image from the first luminance dynamic range to a second luminance dynamic range by multiplying the luminance value of each pixel of the image by its conversion factor, and displaying the converted image on a display apparatus.

Preferably, determining the background luminance value for each pixel of the image comprises, for each pixel in the image, finding an average of the luminescence valve of said pixel and the luminescence valves of nearby pixels.

Preferably, determining the background luminance value for each pixel of the image comprises filtering the image with a low pass filter and determining a luminance value for each pixel of the filtered image.

Preferably, the low pass filter is a directional low pass filter.

Preferably, the image has a greater number of pixels than the filtered image.

Preferably, determining a conversion factor for each pixel of the image comprises determining a plurality of conversion factors for converting between the first luminance dynamic range and the second luminance dynamic range, wherein the plurality of conversion factors is based on the first and second luminance dynamic ranges and selecting from amongst the plurality of conversion factors the conversion factor for each pixel of the image.

Preferably, the method further comprises transforming the image from a RGB color format to a YUV color format before determining a background luminance value for each pixel of the image.

Preferably, the method further comprises transforming the converted image from the YUV color format to the RGB color format before displaying the converted image on a display apparatus.

There is also disclosed herein a method of increasing the luminance dynamic range of a digital image to improve viewable contest and detail in the image, the method comprising:

analyzing the image to determine the luminance dynamic range of the pixels in the image, determining a conversion factor for each pixel in the image based on the luminance dynamic range of the pixels in the image and a target luminance dynamic range, and multiplying a luminance of each pixel of the image by its conversion factor, Preferably, analyzing the image comprises, for each pixel in the image, finding an average of the luminescence valve of said pixel and the luminescence valves of nearby pixels.

Preferably, determining a conversion factor for each pixel in the image comprises providing a plurality of conversion factors for converting between a first luminance dynamic range and a second luminance dynamic range and selecting from amongst the plurality of conversion factors a conversion factor for each pixel of the image based on an average of the luminescence valve of said pixel and the luminescence valves of nearby pixels.

Preferably, the second luminance dynamic range is greater than the first luminance dynamic range Further aspects of the invention will become apparent from the following description which is given by way of example only.

BRIEF DESCRIPTION OF THE DRAWINGS

An exemplary form of the present invention will now be described by way of example only and with reference to the accompanying drawings, in which.

DESCRIPTION OF THE EXEMPLARY EMBODIMENTS

Figure 1:
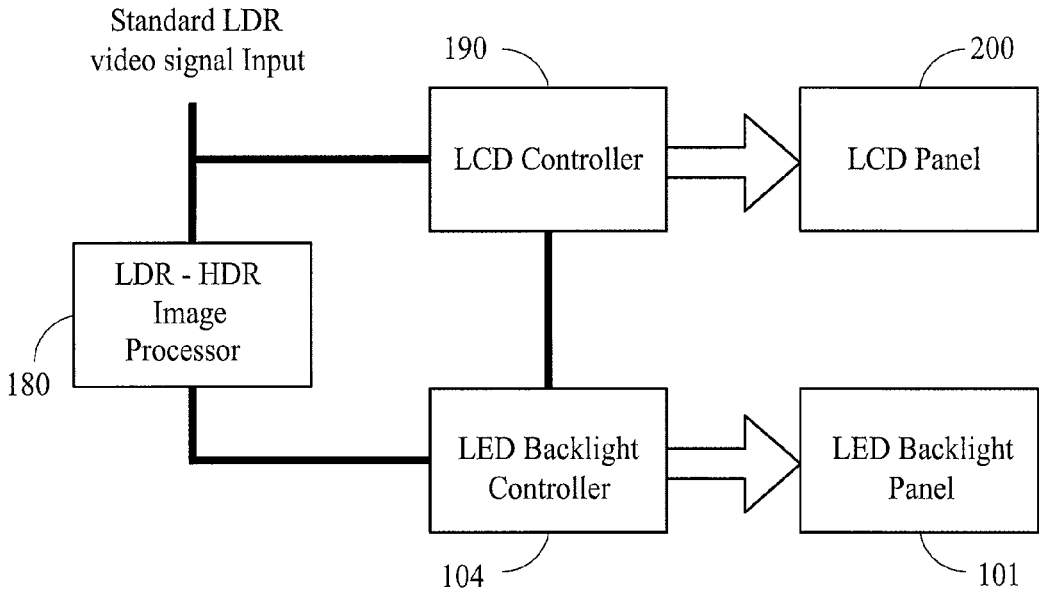
FIG. 1 is a block diagram of a high display apparatus according to the invention.

Reference will now be made in detail to exemplary embodiments of the present invention, examples of which are illustrated in the accompanying drawings, wherein like reference numerals refer to like elements throughout.

Specifically, the present invention relates to a method of increasing the dynamic range of an image and a method of displaying a low dynamic range image in a high dynamic range. However, the invention will be described as embodied in a display device that has a high luminance dynamic range.

The inventors have already proposed in an earlier application Ser. No. 11/707,517 filed on 16 Feb. 2007 a liquid crystal display device having a dynamic backlight that can improve the contrast and luminance dynamic range of the display output. The contents of said application Ser. No. 11/707,517 filed on 16 Feb. 2007 are incorporated herein by reference. In a preferred embodiment of the current invention this liquid crystal display device includes an image luminance processing function for increasing the dynamic range of a received low luminance dynamic range (LDR) image so that the image can be displayed by the device in a higher luminance dynamic range format to improve viewable contrast and detail in the image. In the exemplary example the low LDR image has 8-bit luminance and the image luminance processing function increases the luminance dynamic range to 12-bits.

Figure 3:
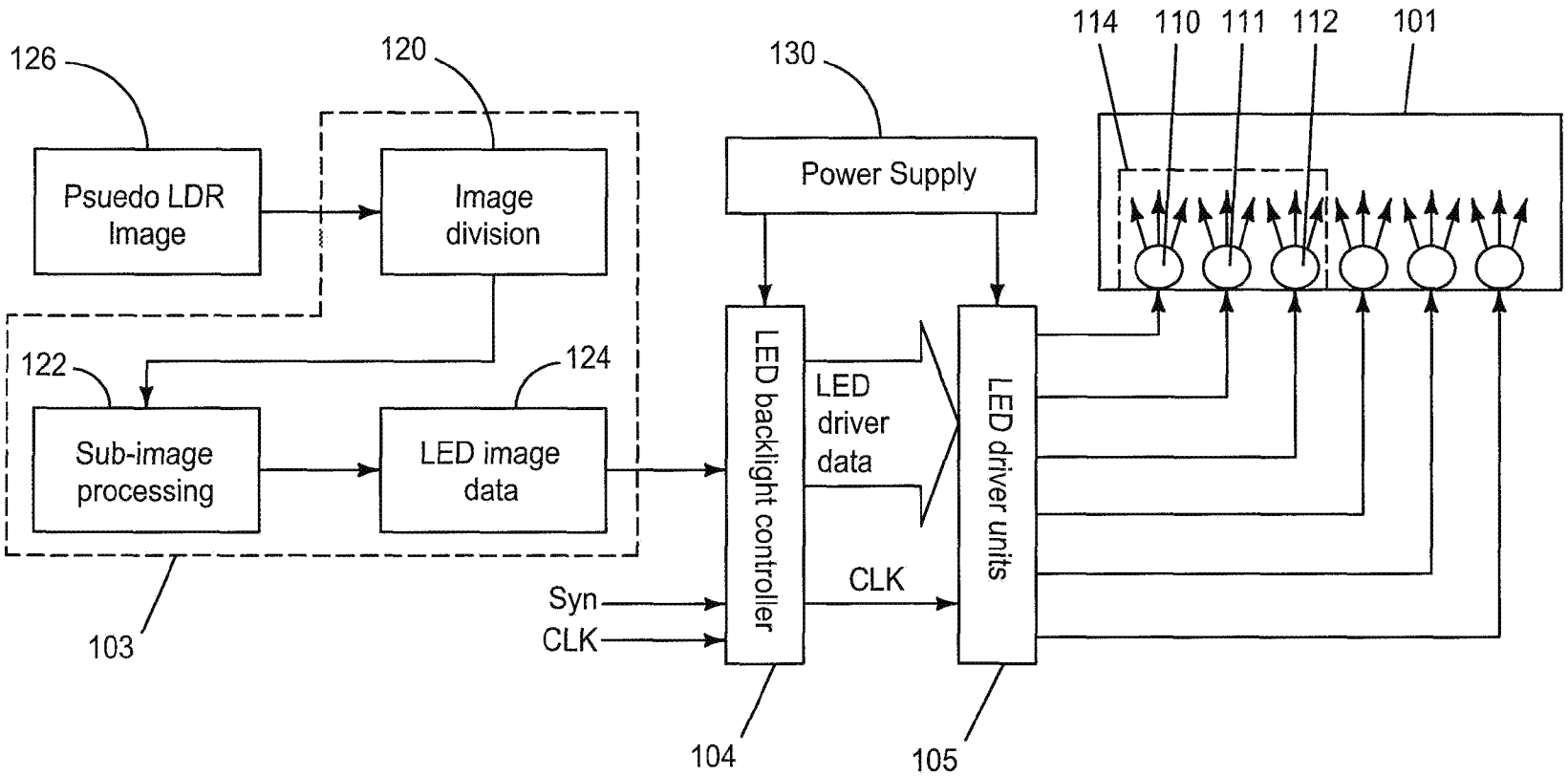
FIG. 3 is a block diagram of the backlight controller and LED panel.

Referring to FIGS. 1 and 3 of the drawings, there is shown a high luminance dynamic range display device, similar to that disclosed in application Ser. No. 11/707,517 filed on 16 Feb. 2007 having a variable intensity backlight device 100 for providing backlighting to a liquid crystal display (LCD) panel 200. The LCD panel has a plurality of light transmissive display elements, partitioned into M×N (where M is the number of columns and N the number of rows) division areas 201 shown by dashed lines 202, and an LCD controller 190 for controlling light transmittance of the light transmissive display elements. The LCD controller 190 receives a standard LDR image and controls the light transmittance of each light transmissive display element accordingly as is known in the art of LCD displays. The backlight device 100 for the LCD panel has a backlight panel 101 on which there is mounted a plurality of light emitting diodes (LEDs) 110, 111, 112 arranged in an M×N array for dynamically backlighting the M×N division areas 201 of the LCD panel 200 and a backlight controller for individually controlling illumination of the LEDs. The device also includes an image luminance processor for converting the LDR image into a high dynamic range (HDR) image for input to the backlight controller. The backlight controller receives the HDR image and analyses the HDR image to generate output signals for the LEDs to individually control LED brightness. By individually controlling the brightness of each LED in combination with the transmittance of the corresponding LCD element the viewed luminance dynamic range of each element of the display device is increased from that of a conventional constant backlit LCD display and the image is viewable as a HDR image.

For the purpose of illustration there are shown 21 M×N division areas 201, which may comprise one or more light transmissive display elements of the LCD panel. In the preferred embodiment each division area 201 comprises fifty-five (55) light transmissive display elements, or pixels, of the LCD panel 200. This is not intended to limit the scope of use or functionally of the invention and the skilled addressee will appreciate that the number of light transmissive display elements and corresponding backlight LEDs is dependent upon the resolution of the display. For example, in a 1024×768 resolution display, namely 1024 (column)×768 (row) LCD pixels, there are a total of 786432 light transmissive display elements. These may be divided in to 12288 division areas each having 64 light transmissive display elements. There would also be 12288 corresponding backlight LEDs. In an extreme example each division area 201 may comprise a single pixel of the display. In a color display each light transmissive display element and corresponding backlight LED comprises individual Red (R), Green (G) and Blue (B) elements and LEDs so that in a resolution of 1024*RGB*768 each division area 201 comprises of one red sub-pixel, one green sub-pixel and one blue sub-pixel.

A video signal decoding unit of the LCD controller receives an input LDR video signal and transforms the LDR video signal into a LDR digital image signal that has the adaptive format of the LCD panel, as is known in the art. The LDR digital image signals contain the 8-bit grayscale level information of the corresponding LCD pixels. Based on the grayscale level, the LCD drivers control the transmittance of the LCD pixels between one of 256 light transmissive states. The video signal decoding unit may have various configurations corresponding to that of the LCD controller. For example, it may comprise an analog input terminal to transmit an input analog video signal to an analog/digital (A/D) converter, and a digital input terminal to support a low-voltage differential signaling (LVDS) or a transition minimized differential signaling (TMDS) interface for a digital video signal output. The work principle of an LCD panel can be found in US patent application publications US20060262077 or US20060109389, or U.S. Pat. No. 7,064,740.

Figure 2:
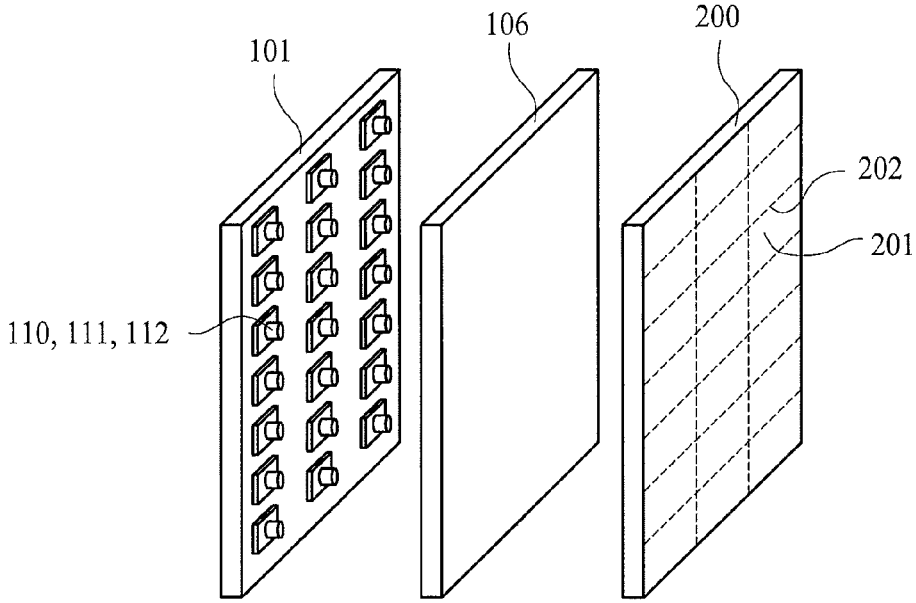
FIG. 2 is an exploded schematic illustration of LED and LCD panels of the device.
Figure 4:
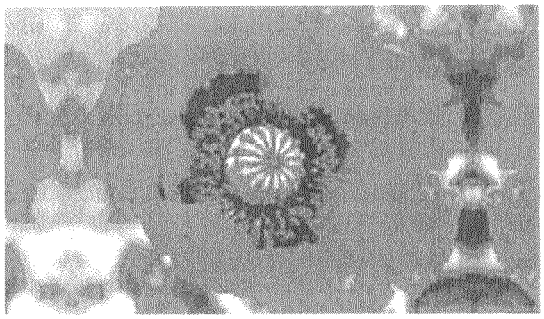
FIG. 4 illustrates a sample grayscale image such as one frame of a video signal.
Figure 5A:
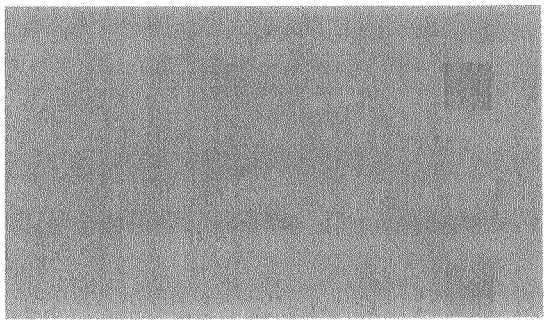
FIGS. 5*a*-5*c* are schematic illustrations of the image of FIG. 4 divided into sub-image groups for each nominal color (Red, Green, Blue)
Figure 5B:
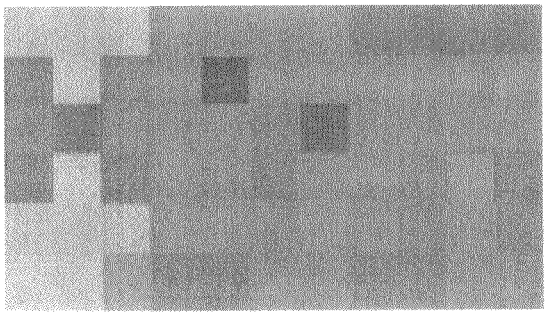
Figure 5C:
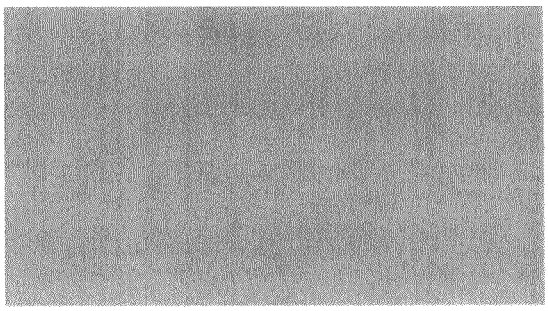

Referring to FIG. 3, the backlight controller comprises an LED image generator 103 for analyzing an input HDR digital image signal 300 from the image processor 180 and generating an LED image signal, a LED controller unit 104 and a plurality of LED drivers 105. A power supply 130 provides power to unit 104 and drivers 105. The LED image generator 103 comprises an image division sub-unit 120 and a sub-image processing sub-unit 122 for dividing the image 300 into sub-images corresponding to the numbers of division areas 201, which in FIG. 2 is 21 (3×7). For each division area 201 of a color image there is one red sub-image, one green sub-image and one blue sub-image. FIG. 4 is an illustration of a sample image such as one frame of a video signal. FIGS. 5*a*-5*c* are illustrations of the red sub-image, green sub-image and blue sub-image respectively from the image of FIG. 4. There are 66 (11×6) division areas shown in the images of FIGS. 5*a*-5*c*.

The sub-image processing unit 122 then processes the sub-images extracting the mean-average grayscale level for each red sub-image, each green sub-image and each blue sub-image. The LED grayscale level is equal to the mean-average grayscale level of the corresponding sub-image. For example, the Red LED grayscale level is the mean average grayscale level of the corresponding red sub-image. Likewise, the Green and Blue LED grayscale levels are obtained according to the mean average grayscale levels of their corresponding sub-images. In FIGS. 5*a*-5*c* each division area is shaded in its mean-average grayscale level of the corresponding red sub-images, green sub-images, and blue sub-images, respectively, of the color image. In the HDR image 126 the grayscale levels are 12-bit, which gives 4069 steps of luminance for the LEDs.

The LED backlight controller 104 then transforms the LED image data 124 and transmits them to corresponding LED drivers 105 in accordance with the address of the LEDs in the backlight panel 101. The LED driver 105 drives the respective R-, G-, B-LEDs 110, 111, 112 to emit light or not emit light and adjusts the intensity of the emitted light on the basis of a control signal from the LED backlight controller 104. The backlight driver 104 powers the LEDs 110, 111, 102 with a pulse width modulated (PWM) signal. The LED driver 105 adjusts both the intensity of electric current and duty cycle of the PWM to be applied to the respective R-, G-, B-LEDs 110, 111, 112, and therefore adjusts the intensity of the light emitted from the respective R-, G-, B-LEDs 110, 111, 112, thereby adjusting the luminance dynamic range of the image that can be displayed by the LCD panel 200.

Figure 6:
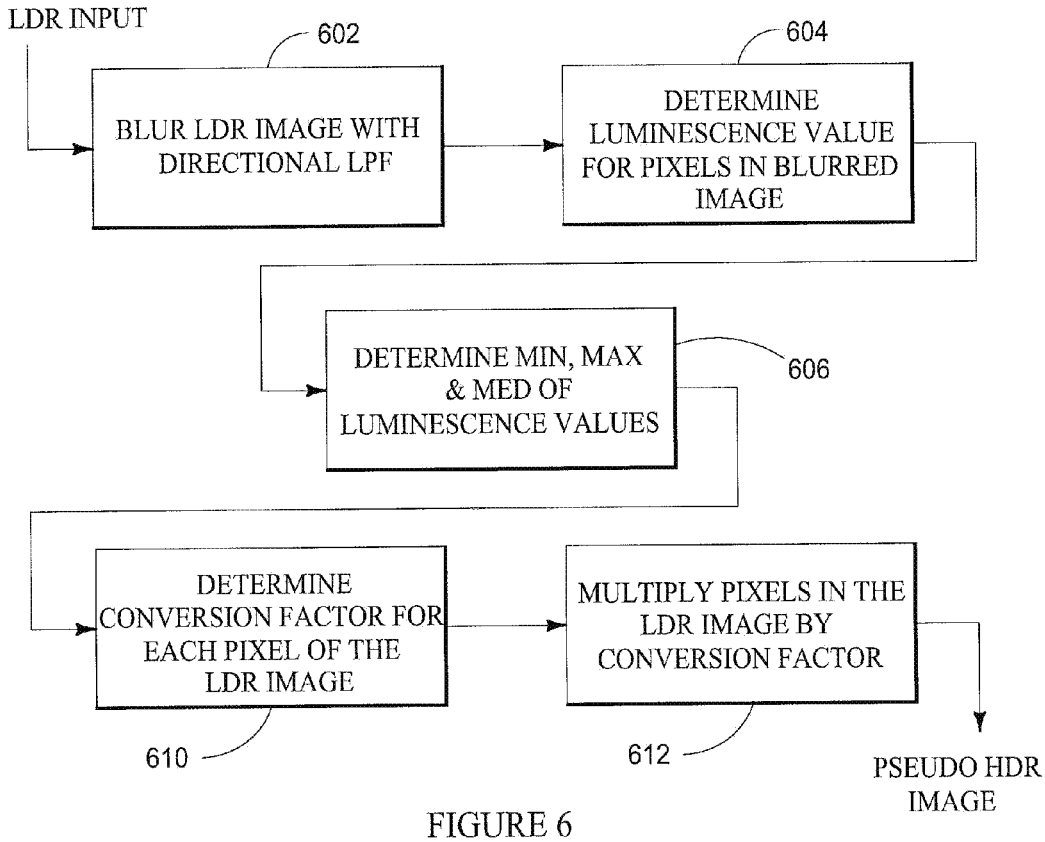
FIG. 6 is a flow diagram of a method of increasing the luminance dynamic range of a digital image.
Figure 7:
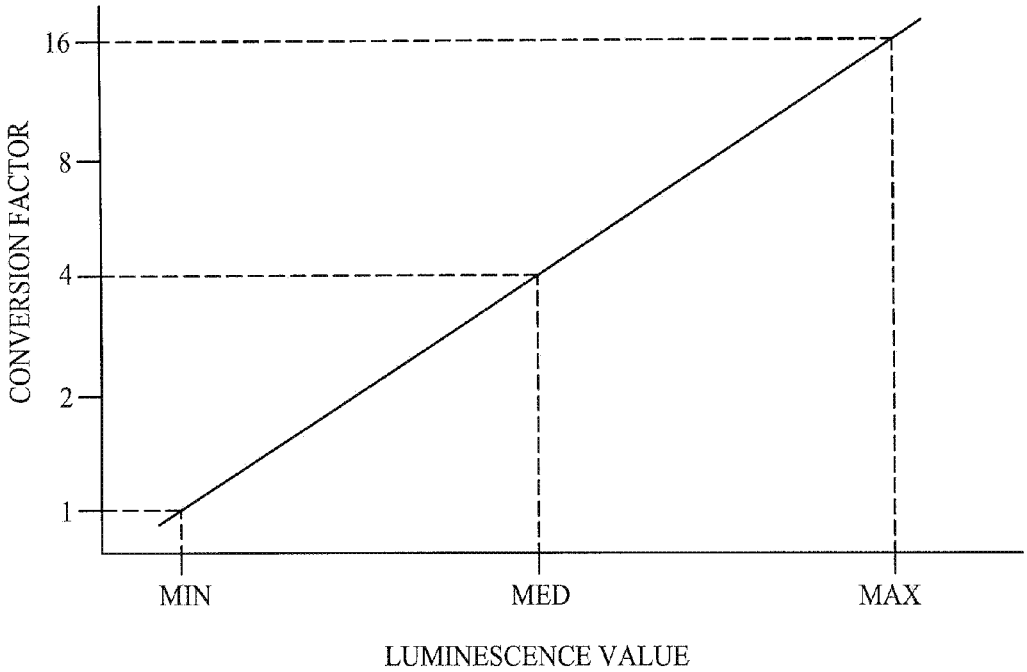
FIG. 7 is an graphical illustration of the method of determine conversion factors for each pixel of the LDR image.

The following description relates to conversion of the received LDR image into a HDR image as shown in FIG. 6. To convert the LDR image to reproduce the accurate corresponding HDR image the input LDR image is analyzed and an ambient image that mimics the light spreading in the real world is produced. By doing so, we can determine how light is distributed in the image. After that, for each spatial location, or pixel, of the image a gain factor is determined base on the corresponding ambient value. The reconstructed HDR image is then obtained by dot product of the LDR image with the gain factor matrix. Further details are given below.

The first step in converting the LDR image to a HDR image is to relate the dynamic range of the LDR image to the dynamic range of illumination that the scene or object in the image would have in the real world. This is done by blurring 602 the LDR image with a directional low pass filter (LPF). The low pass filter blurs 602 the image by decreasing the difference between pixel values by averaging nearby pixels. In the exemplified embodiment this is done by using a 3×3 mask, although masks of other resolutions may be used, and finding the average of the greyscale levels of the pixels in the 3×3 neighbourhood defined by the mask. We then determine 604 a luminance value for each pixel of the blurred image and find 606 a minimum, a maximum and a median of the luminance values. This gives a relative real world luminance dynamic range of the scene or object in the image.

The next step in the conversion process is to determine 610 or find a conversion scale, or in other words a plurality of conversion factors, for converting between the LDR and HDR. This scale is based on the degree of scaling up, or difference, between the LDR image and the target HDR image. In the preferred embodiment the LDR image is an 8-bit image which has 2 to-the-power 8 ($2^8$) or 256 steps of luminance for each pixel. The target dynamic range is a 12-bit image which has 2 to-the-power 12 ($2^{12}$) or 4096 steps of luminance for each pixel. The difference is a factor of 2 to-the-power 4 ($2^4$) or 16 times. If we say that the median pixel luminance in the original image should increase by a factor of 1, that is 2 to-the-power 0 ($2^0$), then the maximum factor must be 2 to-the-power 2 ($2^2$) or 4, and the minimum factor must be 2 to-the-power negative 2 ($2^{-2}$) or 0.25. The scale is normalized to an integer range by multiplying by 4 to find the conversion scale. The conversion scale for the current example is a plurality of numbers in the range of 1 to 16 and the median conversion factor is 4. In alternative embodiments of the invention the conversion factors may be different. For example, if the LDR image is 8-bit (2 to-the-power 8) and the target HDR image is 10-bit (2 to-the-power 10) then the conversion will be 4 times (i.e. 2 to-the-power 2) and have a range from 0.5 (2 to-the-power −1) to 2 (2 to-the-power 1). This is normalized by multiplying by 2 so that the conversion scale is a plurality of numbers in the range of 1 to 4 and the median conversion factor is 2.

The next step in the conversion process is to find 610 from amongst the plurality of conversion factors a conversion factor for each pixel of the image. In order to get a realistic real world conversion the conversion factor for each pixel is determined from the luminance value of its corresponding pixel in the blurred image. The pixel or pixels having the minimum luminance value from the blurred image will have the minimum conversion factor, that is 2 to-the-power negative 2 ($2^{-2}$) or 0.25 in the case of a 8-bit to 12-bit conversion, and the pixel or pixels having the maximum luminance value from the blurred image will have the maximum conversion factor, that is 2 to-the-power 2 ($2^2$) or 4. The conversion factor for the remaining pixels is determined according to a linear relationship between these minimum and maximum values with the constraint that the pixel or pixels having the median luminance value from the blurred image will have a conversion factor of 1. The final step in the conversion is to multiply 612 each pixel in the original image by its conversion factor to convert the luminance dynamic range from 8-bit to the target 12-bit.

In an image in RBG color space the above steps must be performed on each of the three sub-images, i.e. the red sub-image, the green sub-image and the blue sub-image. In an alternative embodiment the original image can first be converted from RGB color space to YUV color space. The dynamic range conversion need only be performed on the Y component, which contains the brightness information. After obtaining the Y component image it is filtered and dynamic range conversion of pixels in the Y component image is preformed. After LDR to HDR conversion of the Y component the new YUV color space image is converted back to RGB color space. Conversion between RGB and YUV color space is expressed by the following two equations.

$$\begin{bmatrix} Y \\ U \\ V \end{bmatrix} = [M] \times \begin{bmatrix} R \\ G \\ B \end{bmatrix} \text{ and } \begin{bmatrix} R' \\ G' \\ B' \end{bmatrix} = [M^{-1}] \times \begin{bmatrix} Y' \\ U \\ V \end{bmatrix}$$

An example calculation is:

$$Y=0.229*R+0.587*G+0.114*B$$

$$U=-0.147*R-0.289*G+0.437*B$$

$$V=0.615*R-0.515*G-0.1*B$$

In yet another alternative embodiment the original image is first converted from RGB color space to YUV color space and the backlight luminance value for each pixel of the blurred image is determined from the Y component image. The final LDR to HDR conversion is then preformed directly on the pixels values in each of the red, green, and blue sub images of the original image. This means that there is no need of re-conversion for the sub-pixel value from YUV to RGB color space after conversion.

Figure 8:
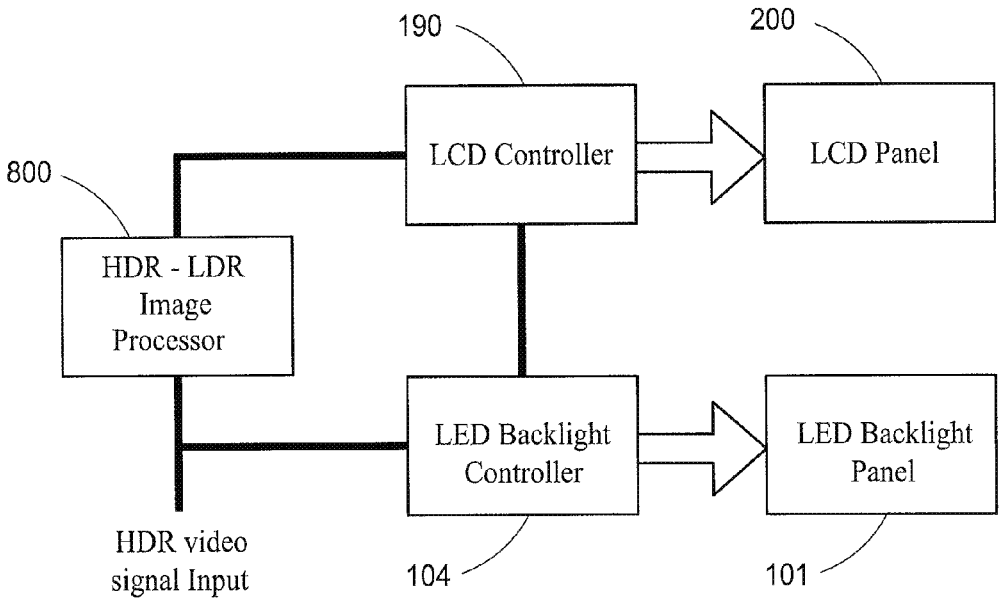
FIG. 8 is a schematic illustration of an alternative embodiment of a high display apparatus.

An exemplary example of the invention has been described. However, it should be appreciated that modifications and alternations obvious to those skilled in the art are not to be considered as beyond the scope of the present invention. One such modification is shown in FIG. 8. It is envisaged that images already in a HDR format may be displayed on the device described in an earlier application Ser. No. 11/707,517 filed on 16 Feb. 2007. Such a device may include a HDR to LDR tone mapping processor 800 for converting the input HDR image to LDR format used by the LCD controller 190 and panel 200.

What is claimed is:

1. A method of increasing the luminance dynamic range of an original image from a first luminance dynamic range to a second luminance dynamic range, the original image comprising a plurality of pixels each having a luminance value within the first luminance dynamic range, the method comprising:

determining filtered image having a filtered luminance value corresponding to each pixel of the plurality of pixels, wherein each filtered luminance value is determined according to luminance values of the pixels in a predetermined area surrounding the corresponding pixel;

determining a minimum, a median and a maximum of the filtered luminance values, providing a plurality of conversion factors having a minimum conversion factor less than a predetermined value and a maximum conversion factor greater than the predetermined value, wherein a range of conversion factors is determined based on a difference between the first and second luminance dynamic ranges;

selecting a conversion factor for each pixel of the original image from the plurality of conversion factors, wherein the selecting is based on the luminance values of the pixels in the filtered image and a constraint that maps the minimum conversion factor to the pixel with the minimum filtered luminance value, maps the maximum conversion factor to the pixel with the maximum filtered luminance value, and maps a conversion factor having the predetermined value to the pixel with the medium filtered luminance value, and converting the original image from the first luminance dynamic range to the second luminance dynamic range by multiplying the luminance value of each pixel of the original image by the corresponding conversion factor;

wherein the minimum conversion factor is calculated as 2 to the power of the minus square root of the result from second luminance dynamic range divided by the first luminance dynamic range, and the maximum conversion factor is calculated as 2 to the power of the square root of the result from second luminance dynamic range divided by the first luminance dynamic range.

2. The method of claim 1 further comprising normalizing the plurality of conversions factors such that the minimum conversion factor after normalization equals to 1.

3. The method of claim 1, wherein the predetermined area is a square area surrounding the corresponding pixel.

4. The method of claim 1, wherein the corresponding pixel is in one line and at least one of the pixels in the predetermined area surrounding the corresponding pixel is in another line.

5. The method of claim 1 wherein determining the filtered luminance value of each pixel in the filtered image comprises filtering the original image with a low pass filter and determining the filtered luminance value for each pixel in the filtered image.

6. The method of claim 5 wherein the low pass filter is a directional low pass filter.

7. The method of claim 5 wherein the original image has a greater number of pixels than the filtered image.

8. The method of claim 1 wherein the original image comprises a red sub-image, a green sub-image and a blue sub-image and the steps of claim 1 are performed on each of the sub-images.

9. The method of claim 1 further comprising transforming the original image from an RGB color format to a YUV color format before determining the filtered luminance value of each pixel in the filtered image.

10. The method of claim 9 wherein the YUV color format comprises a Y component image having pixel luminance information and determining the filtered luminance value of each pixel in the filtered image is performed only on the Y component image.

11. The method of claim 9 further comprising transforming the converted image from the YUV color format to the RGB color format.

12. A display apparatus for displaying an image, comprising:

an LCD panel having a plurality of light transmissive display elements, an LCD panel backlight having a plurality of light emitting devices for backlighting the light transmissive display elements, an image processor programmed to perform a method of increasing the luminance dynamic range of an original image from a first luminance dynamic range to a second luminance dynamic range, the original image comprising a plurality of pixels each having a luminance value within the first luminance dynamic range, the method comprising:

determining a filtered image having a filtered luminance value corresponding to each pixel of the plurality of pixels, wherein each filtered luminance value is determined according to luminance values of the pixels in a predetermined area surrounding the corresponding pixel;

determining a minimum, a median and a maximum of the filtered luminance values, providing a plurality of conversion factors having a minimum conversion factor less than a predetermined value and a maximum conversion factor greater than the predetermined value, wherein a range of conversion factors is determined based on a difference between the first and second luminance dynamic ranges, selecting a conversion factor for each pixel of the original image from the plurality of conversion factors, wherein the selecting is based on the luminance values of the pixels in the filtered image and a constraint that maps the minimum conversion factor to the pixel with the minimum filtered luminance value, maps the maximum conversion factor to the pixel with the maximum filtered luminance value, and maps a conversion factor having the predetermined value to the pixel with the medium filtered luminance value, and converting the original image from the first luminance dynamic range to the second luminance dynamic range by multiplying the luminance value of each pixel of the original image by the corresponding conversion factor;

wherein the minimum conversion factor is calculated as 2 to the power of the minus square root of the result from second luminance dynamic range divided by the first luminance dynamic range, and the maximum conversion factor is calculated as 2 to the power of the square root of the result from second luminance dynamic range divided by the first luminance dynamic range;

an LCD controller for controlling light transmittance of the light transmissive display elements in response to the converted original image having the second luminance dynamic range, and a backlight controller for individually controlling illumination of the light emitting devices in accordance with the determined converted image.

13. A method of displaying an original image comprising a plurality of pixels each having a luminance value within a first luminance dynamic range on a display device having a second luminance dynamic range, the method comprising:

determining a image having a filtered luminance value corresponding to each pixel of the plurality of pixels, wherein each filtered luminance is determined according to luminance values of the pixels in a predetermined area surrounding the corresponding pixel, determining a minimum, a medium and a maximum of the filtered luminance values, providing a plurality of conversion factors having a minimum conversion factor less than a predetermined value and a maximum conversion factor greater than the predetermined value, wherein a range of conversion factors is determined based on a difference between the first and second luminance dynamic ranges;

selecting a conversion factor for each pixel of the original image from the plurality of conversion factors, wherein the selecting is based on the luminance values of the pixels in the filtered image and a constraint that maps the minimum conversion factor to the pixel with the minimum filtered luminance value, maps the maximum conversion factor to the pixel with the maximum filtered luminance value, and maps a conversion factor having the predetermined value to the pixel with the medium filtered luminance value, converting the original image from the first luminance dynamic range to the second luminance dynamic range by multiplying the luminance value of each pixel of the original image by the corresponding conversion factor, and displaying the converted image on a display apparatus;

wherein the minimum conversion factor is calculated as 2 to the power of the minus square root of the result from second luminance dynamic range divided by the first luminance dynamic range, and the maximum conversion factor is calculated as 2 to the power of the square root of the result from second luminance dynamic range divided by the first luminance dynamic range.

14. The method of claim 13 further comprising normalizing the plurality of conversions factors such that the minimum conversion factor after normalization equals to 1.

15. The method of claim 13 wherein determining the filtered luminance value for each pixel of the filtered image comprises filtering the original image with a low pass filter and determining the filtered luminance value for each pixel in the filtered image.

16. The method of claim 15 wherein the low pass filter is a directional low pass filter.

17. The method of claim 15 wherein the original image has a greater number of pixels than the filtered image.

18. The method of claim 13 further comprising transforming the original image from a RGB color format to a YUV color format before determining the filtered luminance value for each pixel of the filtered image.

19. The method of claim 18 further comprising transforming the converted image from the YUV color format to the RGB color format before displaying the converted image on a display apparatus.

20. A method of increasing the dynamic range of an image comprising:

receiving an original image comprising a plurality of pixels each having a luminance value within a first luminance dynamic range;

dividing the original image into a plurality of sub-images the plurality of sub-images comprising a red sub-image, a green sub-image and a blue sub-image, performing, on each of the sub-images, a method of increasing the luminance dynamic range of the respective sub-image from a first luminance dynamic range to a second luminance dynamic range, the respective sub-image comprising a plurality of pixels each having a luminance value within the first luminance dynamic range, the method comprising:

determining a filtered sub-image having a filtered luminance value corresponding to each pixel of the plurality of pixels in the respective sub-image, wherein each filtered luminance value is determined according to luminance values of the pixels in a predetermined area surrounding the corresponding pixel, determining a minimum, a medium and a maximum of the filtered luminance values, providing a plurality of conversion factors having a minimum conversion factor less than a predetermined value and a maximum conversion factor greater than the predetermined value, wherein a range of conversion factors is determined based on a difference between the first and second luminance dynamic ranges, selecting a conversion factor for each pixel of the respective sub-image from the plurality of conversion factors, wherein the selecting is based on the filtered luminance values of the pixels in the corresponding filtered sub-image and a constraint that maps the minimum conversion factor to the pixel with the minimum filtered luminance value, maps the maximum conversion factor to the pixel with the maximum filtered luminance value, and maps the a conversion factor having the predetermined value to the pixel with the medium filtered luminance value, converting the respective sub-image from the first luminance dynamic range to the second luminance dynamic range by multiplying the luminance value of each pixel of the respective sub-image by the corresponding conversion factor, and combining the converted red, green and blue sub-images into a high dynamic range image.

* * * * *